US009098007B2

(12) United States Patent
Rokutan et al.

(10) Patent No.: US 9,098,007 B2
(45) Date of Patent: Aug. 4, 2015

(54) CHARGING MEMBER, CHARGING DEVICE, PROCESS CARTRIDGE, AND IMAGE FORMING APPARATUS

(71) Applicant: FUJI XEROX CO., LTD., Tokyo (JP)

(72) Inventors: Minoru Rokutan, Kanagawa (JP); Hidemi Nukada, Kanagawa (JP); Satoya Sugiura, Kanagawa (JP); Akihiro Nonaka, Kanagawa (JP); Takuro Hagiwara, Kanagawa (JP); Minoru Oshima, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/258,583

(22) Filed: Apr. 22, 2014

(65) Prior Publication Data

US 2015/0125183 A1 May 7, 2015

(30) Foreign Application Priority Data

Nov. 6, 2013 (JP) ..... 2013-230711

(51) Int. Cl.
*G03G 15/02* (2006.01)

(52) U.S. Cl.
CPC ..... *G03G 15/0233* (2013.01)

(58) Field of Classification Search
None
See application file for complete search history.

(56) References Cited

U.S. PATENT DOCUMENTS

2010/0104316 A1* 4/2010 Hoshio et al. ..... 399/100

FOREIGN PATENT DOCUMENTS

| | | | | |
|---|---|---|---|---|
| JP | B2-8-20794 | | 3/1996 | |
| JP | 2002-214879 A | * | 7/2002 | ..... G03G 15/02 |
| JP | A-2002-214879 | | 7/2002 | |
| JP | A-2003-316124 | | 11/2003 | |

* cited by examiner

*Primary Examiner* — Clayton E Laballe
*Assistant Examiner* — Jas Sanghera
(74) *Attorney, Agent, or Firm* — Oliff PLC

(57) ABSTRACT

A charging member includes a conductive elastic layer, and a conductive surface layer that is disposed on the conductive elastic layer, is in contact with an image holding member, and contains a resin, porous resin particles, and silicone oil, wherein a content of the porous resin particles is from 3 parts by weight to 25 parts by weight based on 100 parts by weight of the resin, and a content of the silicone oil is from 0.1 part by weight to 10 parts by weight based on 100 parts by weight of the resin.

11 Claims, 5 Drawing Sheets

CHARGING MEMBER, CHARGING DEVICE, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2013-230711 filed Nov. 6, 2013.

BACKGROUND

1. Technical Field

The present invention relates to a charging member, a charging device, a process cartridge, and an image forming apparatus.

2. Related Art

In an image forming apparatus that uses an electrophotographic system, first, charge is formed using a charging device on the surface of an image holding member formed of a photoconductive photoreceptor containing an inorganic or organic material, an electrostatic latent image is formed using laser beams and the like having undergone image signal modulation, and then the electrostatic latent image is developed using a charged toner, whereby a visualized toner image is formed. The toner image is then electrostatically transferred to a transfer material such as recording paper, directly or through an intermediate transfer member, and fixed to a recording material, whereby a reproduced image is obtained.

SUMMARY

According to an aspect of the invention, there is provided a charging member including:

a conductive elastic layer; and a conductive surface layer that is disposed on the conductive elastic layer, is in contact with an image holding member, and contains a resin, porous resin particles, and silicone oil, wherein a content of the porous resin particles is from 3 parts by weight to 25 parts by weight based on 100 parts by weight of the resin, and a content of the silicone oil is from 0.1 part by weight to 10 parts by weight based on 100 parts by weight of the resin.

BRIEF DESCRIPTION OF THE DRAWINGS

Exemplary embodiments of the present invention will be described in detail based on the following figures, wherein.

DETAILED DESCRIPTION

Hereinafter, the exemplary embodiments of the present invention will be described in detail.

Charging Member

Figure 1:
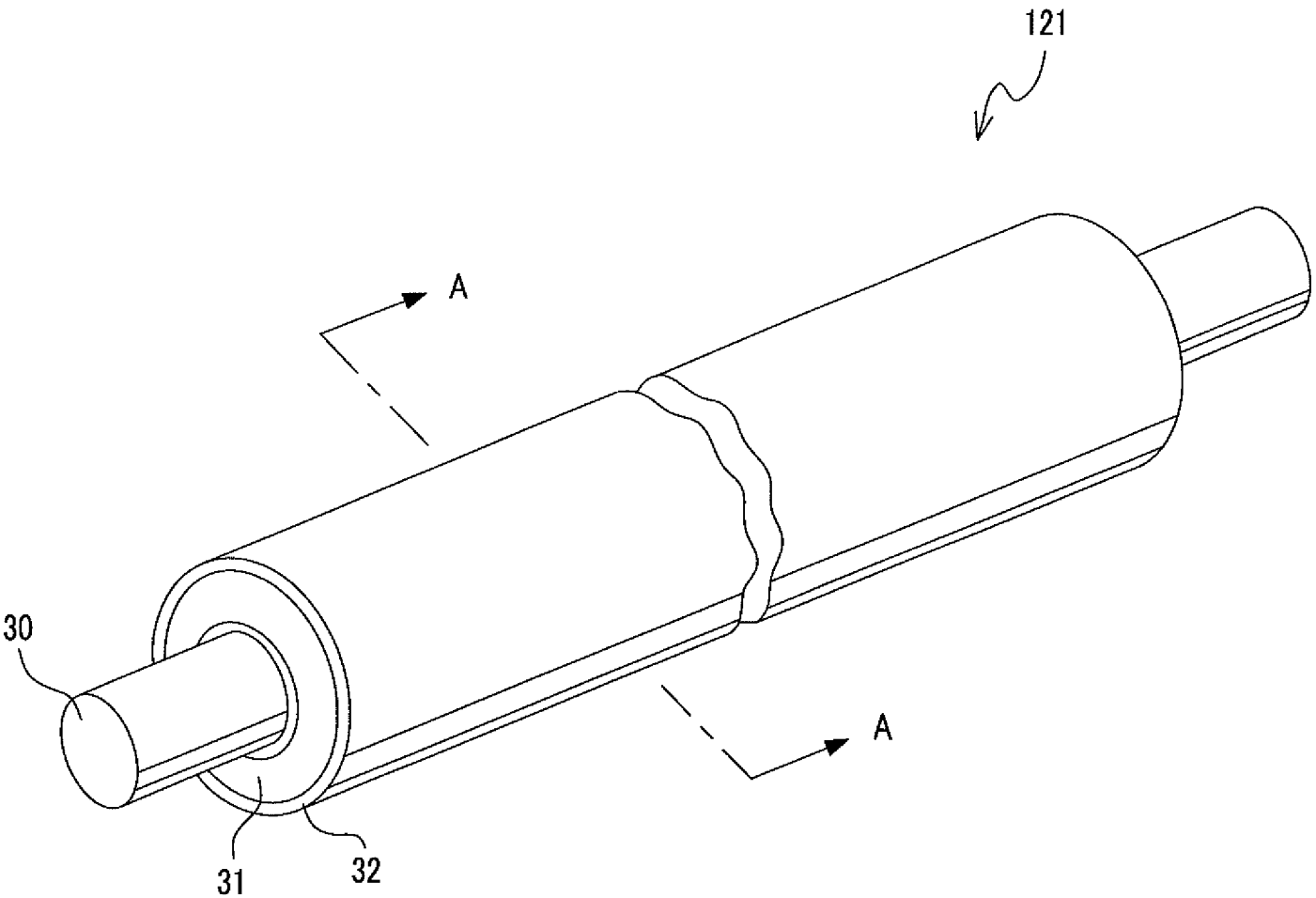
FIG. 1 is a schematic perspective view showing a charging member according to the present exemplary embodiment.
Figure 2:
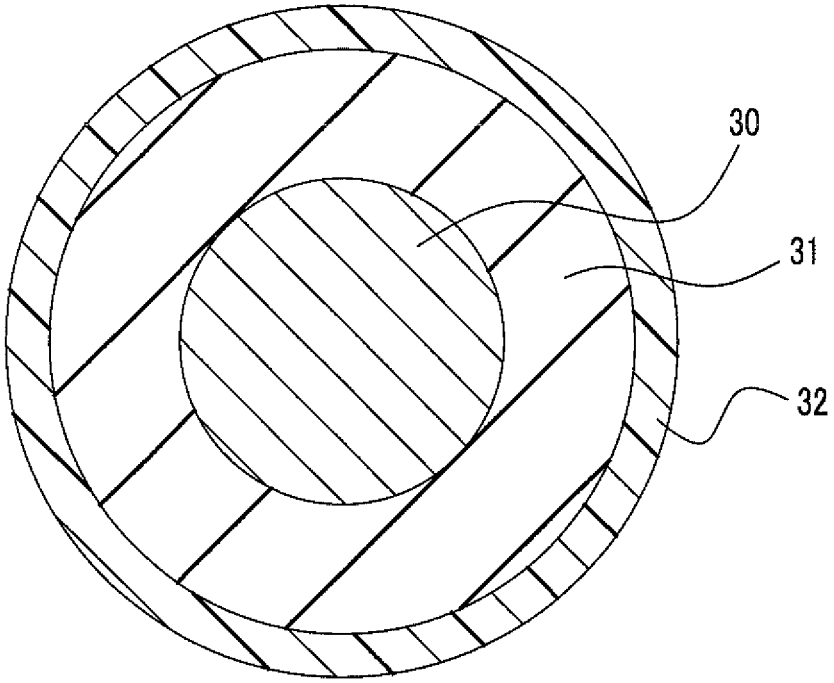
FIG. 2 is a schematic cross-sectional view of the charging member according to the present exemplary embodiment.

FIG. 1 is a schematic perspective view showing a charging member according to the present exemplary embodiment. FIG. 2 is a schematic cross-sectional view of the charging member according to the present exemplary embodiment. FIG. 2 is a cross-sectional view taken along the line A-A of FIG. 1.

As shown in FIGS. 1 and 2, a charging member 121 according to the present exemplary embodiment is a roll member having, for example, a conductive support 30 (hereinafter, referred to as a "support 30"), a conductive elastic layer 31 (hereinafter, referred to as a "elastic layer 31") disposed on the outer circumferential surface of the conductive support 30, and a conductive surface layer 32 (hereinafter, referred to as a "surface layer 32") which is disposed on the outer circumferential surface of the conductive elastic layer 31 and is in contact with an image holding member. Moreover, between the support 30 and the elastic layer 31, for example, there is an adhesive layer (not shown in the drawing).

Furthermore, the surface layer 32 contains a resin, a conductive agent, porous resin particles, and silicone oil, in which the content of the porous resin particles is from 3 parts by weight to 25 parts by weight based on 100 parts by weight of the resin, and the content of the silicone oil is from 0.1 part by weight to 10 parts by weight based on 100 parts by weight of the resin.

The charging member 121 according to the present exemplary embodiment is not limited to the roll member, and may be any of the blade member, brush member, and film member as long as it has the elastic layer 31 and the surface layer 32. Moreover, the layer constitution of the charging member 121 according to the present exemplary embodiment is not limited to the above. For example, the charging member 121 may adopt the constitution in which an intermediate layer is disposed between the support 30 and the elastic layer 31 or the constitution in which a resistance-controlling layer or a transition preventing layer is disposed between the elastic layer 31 and the surface layer 32.

In the present specification, "conductive" means that the volume resistivity at 20° C. is less than $1\times10^{13}$ Ωcm.

It is known that in the charging member (contact-type charging member) having the surface layer 32 which is in contact with an image holding member (photoreceptor), for the purpose of obtaining target surface roughness and suppressing covering (filming) of the surface layer 32 with external additives of the toner, porous resin particles are mixed in the surface layer 32. When the porous resin particles are mixed in the surface layer 32, the adhesiveness between the porous resin particles and the resin is enhanced. Accordingly, it is easy to prevent the particles from being separated from the surface layer 32 and to prevent the surface layer 32 from cracking.

However, when the surface layer 32 is formed by heating a coating film formed of a coating liquid containing the respective components, due to the heating, swirling currents are formed inside the coating film. Consequently, the phenomenon called Benard cell in which a cell structure is observed occurs in some cases. If the Benard cell phenomenon occurs, the porous resin particles are concentrated to the boundary portion of the cell structure, whereby the target surface roughness is not obtained, and the uniformity of resistance of the surface layer 32 deteriorates. As a result, uniform chargeability of the image holding member deteriorates, and the granularity of an image worsens. Particularly, when an image is formed at a high process speed, or when a high-quality image having high resolution is formed, the granularity of the image markedly worsens.

Therefore, in the charging member 121 according to the present exemplary embodiment, the porous resin particles are mixed in the surface layer 32, in an amount of 3 parts by weight to 25 parts by weight based on 100 parts by weight of the resin, and the silicone oil is mixed in the surface layer 32, in an amount of 0.1 part by weight to 10 parts by weight based on 100 parts by weight of the resin. By mixing the porous resin particles and the silicone oil in the surface layer 32 in the above amount, the occurrence of the Benard cell phenomenon caused at the time of forming the surface layer 32 is suppressed.

Consequently, in the charging member 121 according to the present exemplary embodiment, dispersibility of the porous resin particles in the surface layer 32 is improved, and deterioration of the uniformity of resistance is suppressed. Therefore, an image having excellent granularity is obtained.

Hereinafter, the charging member 121 according to the present exemplary embodiment will be described in detail. In the following description, signs will not be described.

Support

The support functions as an electrode and a supporting member of the charging member. Examples of materials thereof include metals such as iron (free-cutting steel or the like), copper, brass, stainless steel, aluminum, and nickel or alloys thereof; iron plated with chromium, nickel, or the like; and the like. Examples of the conductive support include members (for examples, resins or ceramic members) of which the outer circumferential surface has undergone a plating process; members (for example, resins or ceramic members) in which a conductive agent has dispersed; and the like. The support may be a hollow member (cylindrical member) or a non-hollow member.

Adhesive Layer

Examples of materials of the adhesive layer include known adhesives as compositions which bond the support to the elastic layer and exhibit conductivity. Examples of such adhesives include resin compositions containing electroconductive agents and resin compositions containing conductive resins.

Elastic Layer

The elastic layer contains an elastic material and a conductive agent. The elastic layer may optionally contain other additives. Moreover, it is preferable that the elastic layer also function as a resistance-controlling layer.

Examples of the elastic materials include isoprene rubber, chloroprene rubber, epichlorohydrin rubber, butyl rubber, urethane rubber, silicone rubber, fluororubber, styrene-butadiene rubber, butadiene rubber, nitrile rubber, ethylene propylene rubber, epichlorohydrin-ethylene oxide copolymer rubber, epichlorohydrin-ethylene oxide-allyl glycidyl ether copolymer rubber, ethylene-propylene-diene copolymer rubber, acrylonitrile-butadiene copolymer rubber, natural rubber, rubber as a mixture of these, and the like.

Among these elastic materials, silicone rubber, ethylene propylene rubber, epichlorohydrin-ethylene oxide copolymer rubber, epichlorohydrin-ethylene oxide-allyl glycidyl ether copolymer rubber, and rubber as a mixture of these are preferable.

These rubber materials may be foamed or non-foamed.

Examples of the conductive agent include electroconductive materials and ion-conductive materials.

Examples of the electroconductive materials include carbon black such as Ketjen black and acetylene black, pyrolytic carbon, graphite, metals such as zinc, aluminum, copper, iron, nickel, chromium, and titanium, and known metal oxides such as $ZnO—Al_2O_3$, $SnO_2—Sb_2O_3$, $In_2O_3—SnO_2$, $ZnO—TiO_2$, $MgO—Al_2O_3$, $FeO—TiO_2$, $TiO_2$, $SnO_2$, $Sb_2O_3$, $In_2O_3$, ZnO, and MgO.

Examples of the ion-conductive materials include known salts such as quaternary ammonium salts, perchlorates of alkali metals, and perchlorates of alkaline earth metals.

One kind of these conductive agents may be used alone, or two or more kinds thereof may be used in combination.

The content of the conductive agent is not particularly limited as long as the content is within a range in which the characteristics required for the elastic layer are obtained.

Specifically, in the case of the electroconductive material, the content of the conductive agent is preferably from 1 part by weight to 90 parts by weight based on 100 parts by weight of the elastic material.

On the contrary, in the case of the ion-conductive material, the content of the conductive agent is preferably from 0.01 part by weight to 10 parts by weight based on 100 parts by weight of the elastic material.

Examples of other additives that the elastic layer may contain include known additives such as softeners, plasticizers, vulcanizing agents, vulcanization accelerators, antioxidants, surfactants, and coupling agents.

When the elastic layer also functions as, for example, a resistance-controlling layer, the volume resistivity of the elastic layer is, for example, from $10^3$ Ωcm to $10^{14}$ Ωcm, more preferably from $10^5$ Ωcm to $10^{12}$ Ωcm, and even more preferably from $10^7$ Ωcm to $10^{12}$ Ωcm.

The volume resistivity of the elastic layer is a value measured by the following method. From the elastic layer, a sheet-like measurement sample is taken, and voltage, which is adjusted such that the strength of an electric field (applied voltage/thickness of composition sheet) is 1,000 V/cm by using a measurement jig (R12702A/B Resistivity Chamber: manufactured by Advantest Corporation) and a high resistance measurement instrument (R8340A Digital High Resistance/Microammeter: manufactured by Advantest Corporation) according to JIS-K-6911 (1995), is applied to the measurement sample for 30 seconds. Thereafter, from the value of current flowing at this time, the volume resistivity is calculated by the following equation.

Volume resistivity (Ωcm)=(19.63×applied voltage (V))/(current value (A)×thickness of measurement sample (cm))

In view of suppressing a toner or dust from being accumulated in concavities of the surface layer, the surface roughness (ten-point average roughness) Rz of the elastic layer is preferably, for example 20 μm or less.

The surface roughness Rz of the elastic layer is a value measured by the following method. According to JIS B 0601 (1994), three sites including the portions 20 mm away from both ends in the axial direction of the elastic layer (charging member) and the central portion thereof are measured, and the average thereof is taken as the surface roughness. As the measurement apparatus, Surfcom 1400 manufactured by TOKYO SEIMITSU CO., LTD. is used. The measurement conditions are as follows; cutoff: 0.8 mm, measurement length: 2.4 mm, traverse speed: 0.3 mm/sec.

The thickness of the elastic layer varies with the apparatus to which the charging member is applied. However, for example, the thickness is preferably from 1 mm to 10 mm, and more preferably from 2 mm to 5 mm.

The thickness of the elastic layer is a value measured by the following method. Three sites including the portions 20 mm away from the both ends in the axial direction of the elastic layer (charging member) and the central portion thereof are cut off by a single-edged knife. The cross section of the cut off sample is observed under appropriate magnifications of 5× to 50× according to the thickness so as to measure the film thickness, and the average thereof is taken as the thickness of the elastic layer. As the measurement apparatus, a digital microscope VHX-200 manufactured by Keyence Corporation is used.

Surface Layer

The surface layer contains a resin, porous resin particles, and silicone oil (hereinafter, referred to as "polysiloxane" in some cases). The surface layer may optionally contain other additives.

Examples of the resin include acrylic resins, fluorine-modified acrylic resins, silicone-modified acrylic resins, cellulose resins, polyamide resins, copolymer nylon, polyurethane resins, polycarbonate resins, polyester resins, polyimide resins, epoxy resins, silicone resins, polyvinyl alcohol resins, polyvinyl butyral resins, polyvinyl acetal resins, ethylene tetrafluoroethylene resins, melamine resins, polyethylene resins, polyvinyl resins, polyarylate resins, polythiophene resins, polyethylene terephthalate resins (PET), fluororesins (polyvinylidene fluoride resins, ethylene tetrafluoride resins, tetrafluoroethylene-perfluoroalkylvinyl ether copolymers (PFA), tetrafluoroethylene-hexafluoropropylene copolymers (FEP), or the like), and the like. It is preferable for the resins to be obtained by curing or crosslinking curable resins by using a curing agent or a catalyst.

The copolymer nylon is a copolymer which contains one or plural kinds among nylon 610, nylon 11, and nylon 12 as a polymerization unit. Moreover, the copolymer nylon may contain other polymerization units such as nylon 6 and nylon 66.

Among the above, in view of preventing contamination, polyvinylidene fluoride resins, ethylene tetrafluoride resins, and polyamide resins are preferable as the resin. In view of the abrasion resistance of the surface layer and the prevention of separation of the porous resin particles, polyamide resins are more preferable.

Particularly, as the polyamide resins, in view of the abrasion resistance of the surface layer and the prevention of separation of the porous resin particles, alkoxymethylated polyamide (alkoxymethylated nylon) is preferable, and methoxymethylated polyamide (N-methoxymethylated nylon) is more preferable.

Moreover, in view of enhancing the mechanical strength of the surface layer and suppressing cracking of the surface layer, it is preferable for the resin to have a crosslinked structure. When the resin has a crosslinked structure, the gel fraction of the surface layer is preferably from 50% to 100%, and more preferably from 60% to 100%.

The gel fraction is measured based on JIS K6796. Specifically, a measurement sample is taken from the surface layer. The weight of the taken sample is measured, and the result is taken as the weight before solvent extraction. Thereafter, the measurement sample is dipped in a solvent, which is used for preparing a coating liquid for forming the surface layer, for 24 hours, and then the solvent is filtered. The remaining residues are filtered, and the weight thereof is measured. The weight is taken as the weight after extraction. Moreover, according to the following equation, the gel fraction is calculated.

$$\text{gel fraction} = 100 \times (\text{weight after solvent extraction}) / (\text{weight before solvent extraction}) \quad \text{Equation}$$

Examples of the porous resin particles include porous particles of polyamide resins, polyimide resins, polyacrylic acid resins, polymethacrylic resins, polystyrene resins, fluororesins, silicone resins, and the like.

The number average particle size of the porous resin particles is, for example, preferably from 0.1 m to 30 μm, more preferably from 0.5 μm to 20 μm, and even more preferably from 1 μm to 15 μm.

The number average particle size of the porous resin particles is a value measured by the following method. First, the porous resin particles are held on a conductive double-sided tape stuck to an SEM sample stage, and the resultant is taken as a sample. The sample is observed by a scanning electron microscope (SEM). For example, a secondary electron image of the porous resin particle sample is observed with FE-SEM (manufactured by JEOL LTD., JSM-6700F) under the condition of acceleration voltage of 5 kV. Subsequently, the diameter of a circle as large as the projected area of each of 50 porous resin particles is taken as a particle size, and the average thereof is taken as the number average particle size.

The content of the porous resin particles is from 3 parts by weight to 25 parts by weight, preferably from 5 parts by weight to 20 parts by weight, and more preferably from 5 parts by weight to 15 parts by weight, based on 100 parts by weight of the resin.

If the content of the porous resin particles is set to be 3 parts by weight or more, the desired surface roughness of the surface layer can be easily realized, the granularity is improved, and the covering (filming) caused by external additives of the toner is easily suppressed. On the contrary, if the content of the porous resin particles is set to be 25 parts by weight or less, deterioration of the uniformity of resistance of the surface layer is suppressed, and the granularity is improved.

Examples of the silicone oil include straight silicone such as dimethyl silicone oil, methyl hydrogen silicone oil, diphenyl silicone oil, methylphenyl silicone oil, and chlorophenyl silicone oil; and modified silicone oil such as alkyl-modified silicone oil, aralkyl-modified silicone oil, polyether-modified silicone oil, polyester-modified silicone oil, fluoroalkyl-modified silicone oil, amino-modified silicone oil, alkoxy-modified silicone oil, epoxy-modified silicone oil, and carboxyl group-modified silicone oil.

Among the above silicone oil, in view of improving the granularity of an image, at least one kind selected from the group consisting of polyether-modified silicone oil and polyester-modified silicone oil is preferable.

Examples of the polyether-modified silicone oil include silicone oil in which at least one of the side chain, both ends, and one end of a polysiloxane chain has been modified with polyalkylene oxide.

Examples of fatty acid ester-modified silicone oil include silicone oil in which at least one of the side chain, both ends, and one end of a polysiloxane chain has been modified with polyester.

The content of the silicone oil is from 0.1 part by weight to 10 parts by weight, preferably from 0.3 part by weight to 5 parts by weight, and more preferably from 0.5 part by weight to 3 parts by weight, based on 100 parts by weight of the resin.

If the content of the silicone oil is set to be 0.1 part by weight or more, the occurrence of Benard cell phenomenon caused at the time of forming the surface layer 32 is suppressed, and an image having excellent granularity is obtained. On the contrary, if the content of the silicone oil is set to be 10 parts by weight or less, the occurrence of phenomenon (bleeding) in which the silicone oil oozes out of the surface layer is easily suppressed, and the storability of the charging member is improved.

Examples of other additives that the surface layer may contain include known additives which are usually added to the surface layer, such as conductive agents, fillers other than the porous resin particles, curing agents, vulcanizing agents, vulcanizing accelerators, antioxidants, surfactants, and coupling agents.

The volume resistivity of the surface layer is, for example, preferably from $10^3$ Ωcm to $10^{14}$ Ωcm, more preferably from $10^5$ Ωcm to $10^{12}$ Ωcm, and even more preferably from $10^7$ Ωcm to $10^{12}$ Ωcm.

The volume resistivity of the surface layer is a value measured by the following method. The surface layer is coated on a flat plate made of a metal such as aluminum or stainless steel or a sheet-like rubber material having a volume resistivity of 10 Ωcm or less, thereby obtaining a measurement sample. Thereafter, the voltage, which is adjusted such that the strength of an electric field (applied voltage/thickness of composition sheet) is 1,000 V/cm by using a measurement jig (R12702A/B Resistivity Chamber: manufactured by Advantest Corporation) and a high resistance measurement instrument (R8340A Digital High Resistance/Microammeter: manufactured by Advantest Corporation) according to JIS-K-6911 (1995), is applied to the measurement sample for 30 seconds. Subsequently, from the value of current flowing at this time, the volume resistivity is calculated by the following equation.

Volume resistivity (Ωcm)=(19.63×applied voltage (V))/(current value (A)×thickness of measurement sample (cm))

The resistivity of the full device (the entire member) is measured by the following method. On one surface of the elastic layer formed into a sheet shape, the surface layer is formed, thereby obtaining a measurement sample. Thereafter, the voltage, which is obtained by adjusting the strength of an electric field (applied voltage/thickness of measurement sample) to be 1,000 V/cm by using a measurement jig (R12702A/B Resistivity Chamber: manufactured by Advantest Corporation) and a high resistance measurement instrument (R8340A Digital High Resistance/Microammeter: manufactured by Advantest Corporation) according to JIS-K-6911 (1995), is applied to the measurement sample for 30 seconds. Subsequently, from the value of current flowing at this time, the volume resistivity is calculated by the following equation.

Volume resistivity (Ωcm)=(19.63×applied voltage (V))/(current value (A)×thickness of measurement sample (cm)) Equation In view of improving the granularity of an image and suppressing covering (filming) caused by the external additives of the toner, the surface roughness Rz of the surface layer is preferably from 2 μm to 10 μm, more preferably from 3 μm to 8 μm, and even more preferably from 3 μm to 6 μm.

The surface roughness Rz of the surface layer is a value measured by the following method. According to JIS B 0601 (1994), three sites including the portions 20 mm away from both ends in the axial direction of the surface layer (charging member) and the central portion thereof are measured, and the average thereof is taken as the surface roughness. As the measurement apparatus, Surfcom 1400 manufactured by TOKYO SEIMITSU CO., LTD. is used. The measurement conditions are as follows; cutoff: 0.8 mm, measurement length: 2.4 mm, traverse speed: 0.3 mm/sec.

The surface free energy of the surface layer is, for example, preferably from 50 mN/m to 90 mN/m, and more preferably from 55 mN/m to 90 mN/m, since images having excellent granularity may be obtained even if images are repeatedly formed.

The surface free energy of the surface layer is a value measured by the following method. As reagents of which dipolar components, dispersion components, and hydrogen bond components of surface free energy are known, pure water, methylene iodide, α-bromonaphthalene, and ethylene glycol are used, and the contact angle thereof with respect to the surface of the surface layer is measured in the normal-temperature and normal-humidity (22° C., 55% RH) environment by using a contact angle gauge CA-X (trade mane; manufactured by Kyowa Interface Science Co., LTD.). Based on the measured result, the surface free energy is calculated by the Fowkes equation by using surface free energy analyzing software EG-11 (trade name; manufactured by Kyowa Interface Science Co., LTD.). Here, the amount of the reagents added dropwise is set to 2.5 μL, and the contact angle is measured when 60 seconds has elapsed from when the reagents are added dropwise.

Herein, in view of contamination and cracking, the dynamic ultra-micro hardness of the surface of the charging member is, for example, preferably from 0.04 to 0.5, and more preferably from 0.08 to 0.3.

The dynamic ultra-micro hardness (hereinafter, abbreviated to "DH" in some case) of the surface of the charging member is determined by the following method. An indenter is pushed into a sample at a certain pushing speed (mN/s) under a test load of P (mN) by a pushing depth of D (μm), and at this time, DH is calculated by the following equation. Here, in the following equation, a represents a constant resulting from the form of indenter.

$$DH=\alpha\times P/D^2 \quad \text{Equation}$$

Moreover, the dynamic ultra-micro hardness is measured using a dynamic ultra-micro hardness meter DUH-W201S (manufactured by Shimadzu Corporation). The dynamic ultra-micro hardness is determined by measuring the pushing depth D, which is obtained when a triangular pyramidal indenter (vertex angle: 115°, α: 3.8584) is pushed into the surface layer of the charging member at a pushing speed of 0.14 mN/s under a test load of 1.0 mN according to the method for measuring soft materials.

The thickness of the surface layer is, for example, preferably from 2 μm to 25 μm, more preferably from 3 μm to 20 μm, even more preferably from 3 μm to 15 μm, and still more preferably from 5 μm to 15 μm, because within the above range, the substance bled from the elastic layer (the liquid substance oozing out of the elastic layer) and the substance blooming from the elastic layer (the solids precipitated from the elastic layer) are prevented from moving to the surface of the charging member, and the surface layer obtains resistance stability.

The thickness of the surface layer is a value measured by the following method. Three sites including the portions 20 mm away from the both ends in the axial direction of the surface layer (charging member) and the central portion thereof are cut off by a single-edged knife. The cross section of the cut off sample is observed under magnifications of 1,000× so as to measure the film thickness, and the average thereof is taken as the thickness of the surface layer. As the measurement apparatus, a digital microscope VHX-200 manufactured by Keyence Corporation is used.

The surface layer is formed by preparing a coating liquid obtained by dispersing respective components in a solvent, coating the surface of the elastic layer formed in advance with the coating liquid, and then heating the resultant.

Examples of the coating method of the coating liquid include a blade coating method, a wire bar coating method, a spray coating method, a dipping coating method, a bead coating method, an air knife coating method, a curtain coating method, a flow coating method, a ring coating method, a die coating method, an inkjet coating method, and the like.

The solvent used for the coating liquid is not particularly limited, and general solvents may be used. For example, solvents including alcohols such as methanol, ethanol, propanol, and butanol; ketones such as acetone and methyl ethyl ketone; tetrahydrofuran; and ethers such as diethyl ether and dioxane may be used. In addition to these, various solvents may be used. However, as solvents applicable to the dipping coating method that is generally used for manufacturing electrophotographic photoreceptors, alcohol or ketone solvents or solvents as mixture of these are exemplified.

Charging Device

Hereinafter, the charging device according to the present exemplary embodiment will be described.

Figure 3:
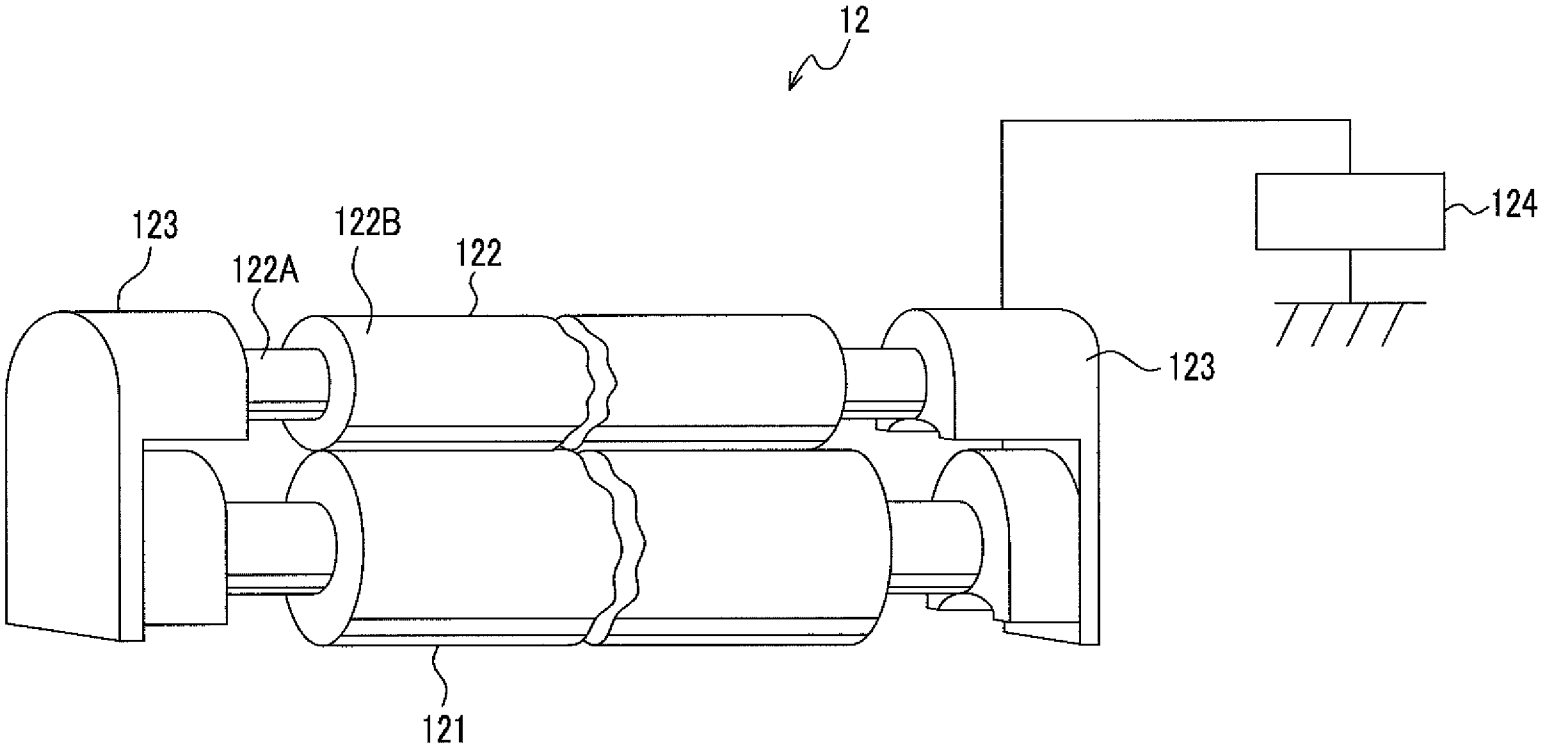
FIG. 3 is a schematic perspective view of a charging device according to the exemplary embodiment.

FIG. 3 is a schematic perspective view of the charging device according to the present exemplary embodiment.

The charging device according to the present exemplary embodiment uses, as a charging member, the charging member according to the present exemplary embodiment described above.

Specifically, in a charging device 12 according to the present exemplary embodiment, for example, the charging member 121 and a cleaning member 122 are disposed while being in contact with each other by a predetermined biting amount as shown in FIG. 3. Moreover, both ends of a base material 30 of the charging member 121 in the axial direction thereof and both ends of a base material 122A of the cleaning member 122 in the axial direction thereof are held by a conductive bearing 123 such that each of the members freely rotates. One side of the conductive bearing 123 is connected to a power supply 124.

The charging device according to the present exemplary embodiment is not limited to the above constitution. For example, the charging device may not include the cleaning member 122.

The cleaning member 122 is a cleaning member for cleaning the surface of the charging member 121, and in the form of, for example, a roll. The cleaning member 122 is constituted with, for example, a cylindrical or columnar base material 122A and an elastic layer 122B disposed on the outer circumferential surface of the base material 122A.

The base material 122A is a conductive rod-like member, and examples of the material thereof include metals such as iron (free-cutting steel or the like), copper, brass, stainless steel, aluminum, and nickel. Moreover, examples of the base material 122A include members (for examples, resins or ceramic members) of which the outer circumferential surface has undergone a plating process; members (for example, resins or ceramic members) in which a conductive agent has dispersed; and the like. The base material 122A may be a hollow member (cylindrical member) or a non-hollow member.

It is preferable that the elastic layer 122B be formed of a foamed material having a porous three-dimensional structure. Moreover, it is preferable that the elastic layer 122B have cavities or concavities and convexities (hereinafter, referred to as "cells") inside or on the surface thereof, and have elasticity. The elastic layer 122B is constituted with foamable resin materials or rubber materials such as polyurethane, polyethylene, polyamide, olefin, melamine, polypropylene, acrylonitrile-butadiene copolymer rubber (NBR), ethylene-propylene-diene copolymer rubber (EPDM), natural rubber, styrene butadiene rubber, chloroprene, silicone, and nitrile.

In order to efficiently clean foreign substances such as a toner or external additives by means of driven frictional slide of the elastic layer that slides along with the charging member 121 and to prevent the surface of the charging member 121 from being easily scratched by being rubbed against the cleaning member 122, or, in order to prevent the elastic layer from being easily shredded or broken over a long time, among the above foamable resin materials or rubber materials, polyurethane, which has a high tearing strength and a high tensile strength, is particularly preferably used.

The polyurethane is not particularly limited, and examples thereof include products obtained from the reaction between polyol (for example, polyester polyol, polyether polyol, or acrylpolyol) and isocyanate (2,4-tolylenediisocyanate, 2,6-tolylenediisocyanate, 4,4-diphenylmethanediisocyanate, tolidine diisocyanate, 1,6-hexamethylenediisocyanate, or the like). The polyurethane may be the product of a reaction caused by a chain extender (for example, 1,4-butanediol or trimethylolpropane) of these. Moreover, the polyurethane is generally foamed using a foaming agent (water or azo compounds (azodicarbonamide, azobisisobutyronitrile, and the like).

The cell number of the elastic layer 122B is preferably from 20/25 mm to 80/25 mm, more preferably from 30/25 mm to 80/25 mm, and particularly preferably from 30/25 mm to 50/25 mm.

The hardness of the elastic layer 122B is preferably from 100 N to 500 N, more preferably from 100 N to 400 N, and particularly preferably from 150 N to 400 N.

The conductive bearing 123 is a member which holds the charging member 121 and the cleaning member 122 so as to make these members freely rotate integrally, and keeps a distance between axes of these members. The conductive bearing 123 may be formed of any material and take any form, as long as it is prepared from a conductive material. For example, the conductive bearing 123 may be a bearing having conductivity or a sliding bearing having conductivity.

The power supply 124 is a device that applies voltage to the conductive bearing 123 such that the charging member 121 and the cleaning member 122 are charged with the same polarity. As the power supply 124, a known high-voltage power supply device is used.

In a charging device 12 according to the present exemplary embodiment, for example, voltage is applied to the conductive bearing 123 from the power supply 124, whereby the charging member 121 and the cleaning member 122 are charged with the same polarity.

Image Forming Apparatus and Process Cartridge

The image forming apparatus according to the present exemplary embodiment includes an image holding member, a charging device that charges the image holding member, a latent image forming device that forms a latent image on the surface of the charged image holding member, a developing device that develops the latent image formed of the surface of the image holding member with a toner to form a toner image, and a transfer device that transfers the toner image formed on the surface of the image holding member to a recording medium. As the charging device, the charging device according to the present exemplary embodiment described above is used.

The process cartridge according to the present exemplary embodiment is, for example, detachable from the image forming apparatus constituted as above, and includes an image holding member, and a charging device that charges the image holding member. As the charging device, the charging device according to the present exemplary embodiment described above is used. The process cartridge according to the present exemplary embodiment may optionally include at least one kind selected from the group consisting of a developing device that develops a latent image formed on the surface of the image holding member with a toner to form a toner image, a transfer device that transfers the toner image formed on the surface of the image holding member to a recording medium, and a cleaning device that removes the toner remaining on the surface of the image holding member after the image is transferred.

Figure 4:
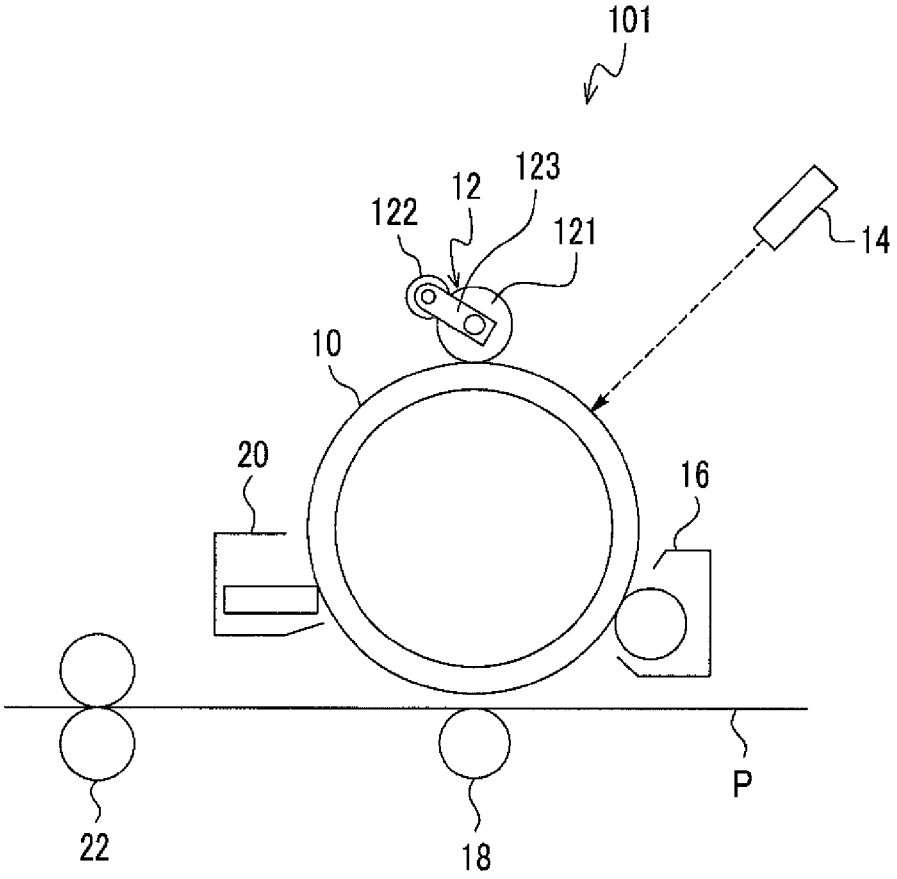
FIG. 4 is a view schematically showing the constitution of an image forming apparatus according to the present exemplary embodiment.
Figure 5:
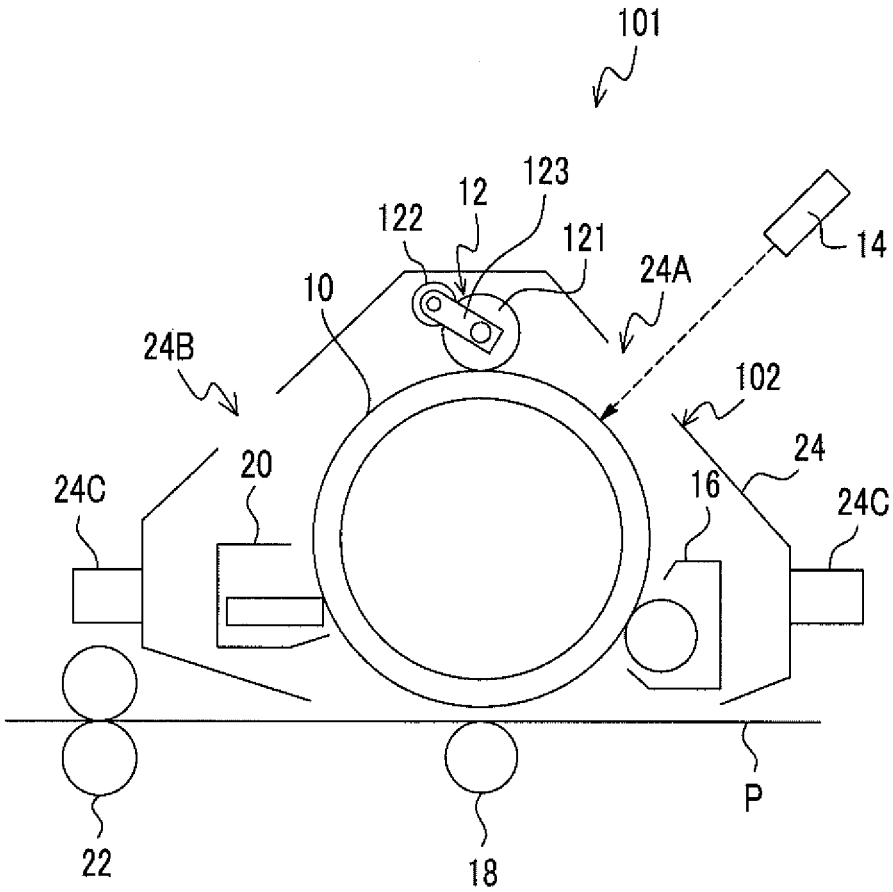
FIG. 5 is a view schematically showing the constitution of a process cartridge according to the present exemplary embodiment.

Next, the image forming apparatus and the process cartridge according to the present exemplary embodiment will be described with reference to drawings. FIG. 4 is a view schematically showing the constitution of the image forming apparatus according to the present exemplary embodiment. FIG. 5 is a view schematically showing the constitution of the process cartridge according to the present exemplary embodiment.

As shown in FIG. 4, an image forming apparatus 101 according to the present exemplary embodiment includes an image holding member 10, and has a charging device 12 that charges the image holding member, an exposure device 14 that forms a latent image by exposing the image holding member 10 charged by the charging device 12 to light, a developing device 16 that develops the latent image formed by the exposure device 14 with a toner to form a toner image, a transfer device 18 that transfers the toner image formed by the developing device 16 to a recording medium P, and a cleaning device 20 that removes the toner remaining on the surface of the image holding member 10 after the image is transferred, which are disposed around the image holding member 10. The image forming apparatus 101 also includes a fixing device 22 that fixes the toner image transferred to the recording medium P by the transfer device 18.

Moreover, the image forming apparatus 101 according to the present exemplary embodiment uses, as the charging device 12, for example, the charging device according to the present exemplary embodiment described above that includes the charging member 121, the cleaning member 122 that is disposed to be in contact with the charging member 121, the conductive bearing 123 that holds both ends of the charging member 121 in the axial direction thereof and both ends of the cleaning member 122 in the axial direction thereof such that each of these members freely rotates, and the power supply 124 that is connected to one side of the conductive bearing 123.

Meanwhile, the image forming apparatus 101 of the present exemplary embodiment is constituted with the constituents known as the respective constituents of the conventional electrophotographic image forming apparatus, except for the charging device 12 (charging member 121). Hereinafter, an example of the respective constituents will be described.

The image holding member 10 is not particularly limited, and a known photoreceptor may be used. However, it is preferable to use an organic photoreceptor which has a so-called functional separation-type structure in which a photosensitive layer is divided into a charge generation layer and a charge transport layer. Moreover, as the image holding member 10, a member of which the surface layer is covered with a protective layer having charge transport properties and a crosslinked structure is preferably used. A photoreceptor configured to have siloxane resins, phenol resins, melamine resins, guanamine resins, or acrylic resins as a crosslinking component of the protective layer is also preferably used.

As an exposure device 14, for example, a laser optical system, a light emitting diode (LED) array, and the like are used.

A developing device 16 is, for example, a developing device that brings a developer holding member, which has a developer layer formed on the surface thereof, into contact with or close to the image holding member 10 so as to form a toner image by causing a toner to adhere to the latent image on the surface of the image holding member 10. For the developing device 16, a development method, which is a known method using two-component developer, is preferably used. The development method using a two-component developer include, for example, a cascade method and a magnetic brush method.

As the transfer device 18, for example, any of the device that uses a non-contact transfer method, such as a corotron, and the device that uses a contact transfer method in which a conductive transfer roll is brought into contact with the image holding member 10 via the recording medium P so as to transfer the toner image to the recording medium P may be used.

A cleaning device 20 is, for example, a member that brings a cleaning blade into direct contact with the surface of the image holding member 10 so as to remove the toner, paper dust, dust, and the like having adhered to the surface. As the cleaning device 20, a cleaning brush, a cleaning roll, and the like may be used other than the cleaning blade.

As the fixing device 22, a thermal fixing device using a heat roll is preferably used. The thermal fixing device is constituted with, for example, a fixing roller that has a heater lamp for heating inside of a cylindrical core and has a so-called release layer formed of a heat-resistant resin coating layer or a heat-resistant rubber coating layer on the outer circumferential surface of the cylindrical core, and a pressure roller or a pressure belt that is disposed to come into contact with the fixing roller under a predetermined contact pressure and has a heat-resistant elastic layer formed on the outer circumferential surface of the cylindrical core or on the surface of a belt-like base material. In the process of fixing the unfixed toner image, for example, the recording medium P, to which the unfixed toner image has been transferred, is inserted between the fixing roller and the pressure roller or between the fixing roller and the pressure belt, and a binder resin, additives, and the like in the toner are thermally melted to fix the image.

The image forming apparatus 101 according to the present exemplary embodiment is not limited to the above configuration. For example, the image forming apparatus 101 may be an image forming apparatus which utilizes an intermediate transfer method using an intermediate transfer member or a so-called tandem-type image forming apparatus in which image forming units forming toner image of each color are arranged in parallel.

As shown in FIG. 5, the process cartridge according to the present exemplary embodiment is a process cartridge 102 that integrally holds a combination of the image holding member 10, the charging device 12 that charges the image holding member, the developing device 16 that develops a latent image formed by the exposure device 14 with a toner to form a toner image, and the cleaning device 20 that removes the toner remaining on the surface of the image holding member 10 after the image is transferred, in the image forming apparatus shown in FIG. 4 by using a housing 24 including an opening portion 24A for exposure, an opening portion 24B for erasing exposure, and a mounting rail 24C. Moreover, the process cartridge 102 is detachably mounted on the image forming apparatus 101 shown in FIG. 4.

EXAMPLES

Hereinafter, the present invention will be described in more detail based on examples, but the present invention is not limited to the following examples. Moreover, unless otherwise specified, "part" means "part by weight".

Example 1

Preparation of Charging Roller A

Formation of Elastic Layer

A mixture composed as shown in Table 1 (the unit of mixing ratio in Table 1 is "part by weight") is kneaded with an open roll, and by using a press molding machine, the resultant is formed into a roll having a diameter of 12.5 mm, on the surface of a conductive support which is made of SUS303 and has a diameter of 8 mm, via an adhesive layer. Thereafter, by polishing the resultant, a conductive elastic roll having a diameter of 12 mm is obtained.

TABLE 1

| | Material | Mixing ratio (part by weight) |
|---|---|---|
| Rubber | Epichlorohydrin rubber (Hydrin T3106/manufactured by ZEON CORPORATION) | 100 |
| Conductive agent | Carbon black (#55/manufactured by ASAHI CARBON CO., LTD.) | 20 |
| | Benzyltriethylammonium chloride (manufactured by KANTO CHEMICAL CO., INC. ) | 1 |
| Vulcanizing agent | Sulfer (Sulfax PS/manufactured by TSURUMI CHEMICAL INDUSTRIES CO., LTD.) | 0.5 |
| Vulcanization accelerator | Tetramethyl lithium disulfide (Nocceler TT/manufactured by OUCHI SHINKO CHEMICAL INDUSTRIAL CO., LTD.) | 1.5 |
| | Dibenzothiazole disulfide (Nocceler DM/manufactured by OUCHI SHINKO CHEMICAL INDUSTRIAL CO., LTD.) | 1.5 |
| Vulcanization-accelerating aid | Zinc oxide (zinc oxide of JIS 1 grade/manufactured by SEIDO CHEMICAL INDUSTRY CO., LTD.) | 5 |
| Filler | Calcium carbonate (Silver-W/manufactured by SHIRAISHI KOGYO KAISHA, LTD.) | 20 |
| Lubricant | Stearic acid (manufactured by KANTO CHEMICAL CO., INC.) | 1 |

Formation of Surface Layer 15 parts by weight of the mixture composed as shown in Table 2 (the unit of mixing ratio in Table 2 is "part by weight") is diluted with 85 parts by weight of methanol, and the resultant is dispersed using a bead mill, thereby obtaining a dispersion. The outer circumferential surface of the elastic layer of the conductive elastic roll obtained as above is coated with the dispersion by dipping coating. Thereafter, the resultant is crosslinked by being heated for 30 minutes at 140° C. and dried so as to form a surface layer having a thickness of 15 μm, thereby obtaining a charging roll A.

TABLE 2

| | Material | Mixing ratio (part by weight) |
|---|---|---|
| Resin | N-methoxymethylated polyamide (F30K/manufactured by Nagase chemteX Corporation.) | 90 |
| | Polyvinyl butyral resin (S-LEC BL-1/manufactured by SEKISUI CHEMICAL CO., LTD.) | 10 |
| Conductive agent | Carbon black (MONARCH 1000/manufactured by Cabot Corporation.) | 13 |

TABLE 2-continued

| | Material | Mixing ratio (part by weight) |
|---|---|---|
| Porous resin particles | Porous polyamide filler (Orgasol(registered trademark) 2001UDNAT1/manufactured by Arkema Inc.) Number average particle size = 5 μm | 20 |
| Catalyst | Acid catalyst (NACURE 4167/manufactured by King Industries, Inc.) | 1.0 |
| Silicone oil | Polyether-modified polydimethylsiloxane (BYK 307/manufactured by BYK Additives & instruments) | 0.1 |

Example 2

A charging roll B is obtained in the same manner as in Example 1, except that the mixing ratio of the porous polyamide filler is set to 10 parts by weight, and the mixing ratio of the polyether-modified polydimethylsiloxane is set to 0.5 part by weight so as to form a surface layer having a film thickness of 10 μm.

Example 3

A charging roll C is obtained in the same manner as in Example 2, except that the mixing ratio of the polyether-modified polydimethylsiloxane is set to 1.0 part by weight so as to form a surface layer having a film thickness of 10 μm.

Example 4

A charging roll D is obtained in the same manner as in Example 1, except that the mixing ratio of the porous polyamide filler is set to 5 parts by weight, and the mixing ratio of the polyether-modified polydimethylsiloxane is set to 1.0 part by weight so as to form a surface layer having a film thickness of 10 μm.

Example 5

A charging roll E is obtained in the same manner as in Example 1, except that the mixing ratio of the porous polyamide filler is set to 3 parts by weight, and the mixing ratio of the polyether-modified polydimethylsiloxane is set to 10 parts by weight so as to form a surface layer having a film thickness of 3 μm.

Example 6

A charging roll F is obtained in the same manner as in Example 3, except that polyester-modified polydimethylsiloxane (trade name: BYK 310/manufactured by BYK Additives & Instruments) is used instead of the polyether-modified polydimethylsiloxane so as to form a surface layer having a film thickness of 10 μm.

Comparative Example 1

A charging roll G is obtained in the same manner as in Example 2, except that a surface layer having a film thickness of 10 μm is formed without mixing in the polyether-modified polydimethylsiloxane.

Comparative Example 2

A charging roll H is obtained in the same manner as in Example 1, except that the mixing ratio of the porous polyamide filler is set to 26 parts by weight.

Comparative Example 3

A charging roll I is obtained in the same manner as in Example 1, except that the mixing ratio of the porous polyamide filler is set to 2 parts by weight, and the mixing ratio of the polyether-modified polydimethylsiloxane is set to 15 parts by weight so as to form a surface layer having a film thickness of 3 μm.

Example 7

A charging roll J is obtained in the same manner as in Example 3, except that fluorine-modified polysiloxane (trade name: FL-100, manufactured by Shin-Etsu Chemical Co., Ltd.) is used instead of the polyether-modified polydimethylsiloxane so as to form a surface layer having a film thickness of 10 μm.

Example 8

A charging roll K is obtained in the same manner as in Example 3, except that the mixing ratio of the porous polyamide filler is set to 25 parts by weight so as to form a surface layer having a film thickness of 10 μm.

Example 9

A charging roll L is obtained in the same manner as in Example 3, except that a dispersion obtained by dispersing a mixture composed as below by using a bead mill is diluted with methyl ethyl ketone (MEK), the surface of the aforementioned conductive elastic roll is coated with the diluted solution by dipping coating, and then the resultant is dried by being heated for 30 minutes at 180° C.

Polymer material: 100 parts by weight (saturated copolymer polyester resin solution Vylon 30SS: manufactured by TOYOBO CO., LTD.)

Curing agent: 26.3 parts by weight (amino resin solution Super Beckamine G-821-60: manufactured by DIC Corporation)

Conductive agent: 13 parts by weight (carbon black MONARCH 1000: manufactured by Cabot Corporation)

Porous resin particles: 10 parts by weight (porous polyamide filler Orgasol(registered trademark) 2001UDNAT1/manufactured by Arkema Inc.)

Acid catalyst (NACURE 4167/manufactured by King Industries, Inc.): 1.0 part by weight Silicone oil: 1.0 part by weight (polyether-modified polydimethylsiloxane BYK 307/manufactured by BYK Additives & Instruments)

Comparative Example 4

A charging roll M is obtained in the same manner as in Example 8, except that the mixing ratio of the polyether-modified polydimethylsiloxane is set to 0.08 part by weight.

Evaluation 1

According to the aforementioned methods, the charging rolls prepared in the respective examples are measured in terms of the surface roughness Rz of the surface layer, the thickness, the surface free energy, and the volume resistivity of the object to be measured that is obtained by coating an elastic layer sheet with the surface layer. Moreover, the surface layer of the charging rolls prepared in the respective examples is observed to confirm whether the Benard cells have been formed. The results are shown in Table 3.

Observation of Benard Cell

By using a digital microscope VHX-200 (manufactured by Keyence Corporation) as a measurement apparatus, the central portion of the charging roll in the axial direction thereof is observed under magnifications of 500×, whereby whether or not the Benard cells are present is confirmed.

Evaluation 2

The charging rolls prepared in the respective examples are mounted on a machine obtained by modifying 700 Digital Color Press manufactured by Fuji Xerox Co., Ltd. and evaluated as below. The results are summarized in Table 3.

Evaluation of Granularity of Image

Color noise is evaluated in the following manner. Patches having a size of 20 mm×20 mm are collected, in increments of an image density of 10% within an image density range of 10% to 100%. Among the patches, the patches having the highest roughness are selected and visually evaluated.

G1: The patch does not feel rough.

G2: The patch feels slightly rough.

G3: The patch feels rough.

G4: The patch feels very rough.

Evaluation of Cracking of Surface Layer

A Random chart having an image density of 5% is printed on 200,000 sheets of A4 papers in an environment of 10° C. and 15% RH, and then the entire surface of the surface layer is observed with a digital microscope VHX-200 (manufactured by Keyence Corporation) under magnifications of 700× to 1,000× for evaluation.

G1: A crack is not formed over the entire surface.

G2: Very tiny cracks are scattered at the edge (1 to 5 cracks).

G3: Tiny cracks are scattered at the edge (6 to 10 cracks).

G4: Cracks are formed at the edge (11 or more cracks).

Storability Evaluation

The charging rolls are mounted on a drum cartridge for 700 Digital Color Press manufactured by Fuji Xerox Co., Ltd. and left as they are for 1 month in an environment of 45° C. and 95% RH. Thereafter, the drum cartridge is mounted on a machine obtained by modifying 700 Digital Color Press manufactured by Fuji Xerox Co., Ltd., and full half-tone images having an image density of 30% are output in a normal temperature-normal humidity (22° C., 55% RH) environment. Based on the following criteria, whether or not streaks of the charging roll pitch and the photoreceptor pitch are formed in the half-tone image is visually observed and evaluated.

G1: No streaks are formed.

G2: Extremely tiny streaks are formed.

G3: Tiny streaks are formed.

G4: Streaks are formed.

Evaluation of Charging Roll Contamination

A full half-tone image having an image density of 30% is output on 100,000 sheets of A3 papers (manufactured by Fuji Xerox Co., Ltd.) in a normal temperature-normal humidity (22° C., 55% RH) environment. Thereafter, the charging roll is taken out of the apparatus, and to what degree the charging roll is contaminated is visually observed and evaluated based on the following criteria.

G1: The charging roll is extremely slightly contaminated.

G2: The charging roll is slightly contaminated.

G3: The charging roll is contaminated

G4: The charging roll is seriously contaminated. .

TABLE 3

| | Charging roll No. | Surface layer: Porous resin particles Mixing ratio Part by weight | Silicone oil Mixing ratio Part by weight | Silicone oil Type of modification | Thickness (μm) | Surface roughness Rz (μm) | Surface free energy (mN/m) | Volume resistivity ($\times 10^6$ Ωcm) |
|---|---|---|---|---|---|---|---|---|
| Example 1 | A | 20 | 0.1 | Polyether modification | 15 | 7 | 55 | 9.0 |
| Example 2 | B | 10 | 0.5 | Polyether modification | 10 | 5 | 75 | 6.8 |
| Example 3 | C | 10 | 1.0 | Polyether modification | 10 | 5 | 80 | 6.9 |
| Example 4 | D | 5 | 1.0 | Polyether modification | 10 | 3 | 85 | 5.9 |
| Example 5 | E | 3 | 10 | Polyether modification | 3 | 2 | 90 | 5.6 |
| Example 6 | F | 10 | 1.0 | Polyester modification | 10 | 6 | 75 | 6.9 |
| Comparative example 1 | G | 10 | 0 | — | 10 | 6 | 40 | 6.8 |
| Comparative example 2 | H | 26 | 0.1 | Polyether modification | 15 | 11 | 30 | 10.7 |
| Comparative example 3 | I | 2 | 15 | Polyether modification | 3 | 1.5 | 25 | 5.5 |
| Example 7 | J | 10 | 1.0 | Fluorine modification | 10 | 6 | 85 | 7.0 |
| Example 8 | K | 25 | 1.0 | Polyether modification | 10 | 10 | 60 | 10.6 |
| Example 9 | L | 10 | 1.0 | Polyether modification | 10 | 4 | 85 | 6.9 |
| Comparative example 4 | M | 25 | 0.08 | Polyether modification | 10 | 10 | 25 | 10.5 |

| | Evaluation: Occurrence of Benard cell | Granularity of image | Cracking of surface layer | Streak of charging roll pitch after storage | Streak of photoreceptor pitch after storage | Contamination of charging roll |
|---|---|---|---|---|---|---|
| Example 1 | No | G2 | G2 | G1 | G1 | G2 |
| Example 2 | No | G1 | G1 | G1 | G1 | G2 |
| Example 3 | No | G1 | G1 | G1 | G1 | G1 |
| Example 4 | No | G1 | G1 | G1 | G1 | G1 |
| Example 5 | No | G1 | G1 | G1 | G2 | G2 |
| Example 6 | No | G1 | G1 | G1 | G1 | G1 |
| Comparative example 1 | Yes | G4 | G1 | G4 | G1 | G3 |
| Comparative example 2 | No | G4 | G2 | G1 | G4 | G4 |
| Comparative example 3 | No | G1 | G1 | G1 | G4 | G2 |
| Example 7 | No | G2 | G2 | G3 | G3 | G2 |
| Example 8 | No | G3 | G2 | G1 | G1 | G3 |
| Example 9 | No | G1 | G1 | G1 | G1 | G2 |
| Comparative example 4 | No | G4 | G2 | G1 | G1 | G4 |

From the above results, it is understood that the granularity of an image is better in the present examples than in Comparative examples 1 and 2. It is also understood that the results of the evaluation of cracking of surface layer, the evaluation of storage, and the evaluation of contamination of charging roll are excellent in the present examples.

Particularly, it is understood that the present Examples 3 and 6, in which the silicone oil modified with polyether or polyester is used, exhibit superior granularity of images, compared to Example 7 in which the fluorine-modified silicone oil is used.

Moreover, in Comparative example 3, since an excess amount of the silicone oil is mixed in, the result of the evaluation of storability (formation of streaks of photoreceptor pitch) is poorer than in examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A charging member comprising:

a conductive elastic layer; and a conductive surface layer that is disposed on the conductive elastic layer, is in contact with an image holding member, and contains a resin, porous resin particles, and silicone oil, wherein a content of the porous resin particles is from 3 parts by weight to 25 parts by weight based on 100 parts by weight of the resin, and a content of the silicone oil is from 0.1 part by weight to 10 parts by weight based on 100 parts by weight of the resin, and wherein the conductive surface layer has a surface free energy of from 50 mN/m to 90 mN/m.

2. The charging member according to claim 1, wherein the silicone oil is at least one kind selected from the group consisting of polyether-modified silicone oil and polyester-modified silicone oil.

3. The charging member according to claim 1, wherein the conductive surface layer has a thickness of from 3 μm to 15 μm.

4. The charging member according to claim 1, wherein the conductive surface layer has a surface free energy of from 55 mN/m to 90 mN/m.

5. The charging member according to claim 1, wherein the conductive surface layer has a ten-point average roughness Rz of from 2 μm to 10 μm.

6. The charging member according to claim 1, wherein a content of the silicone oil is from 0.3 part by weight to 5 parts by weight based on 100 parts by weight of the resin.

7. The charging member according to claim 1, wherein a content of the silicone oil is from 0.5 part by weight to 3 parts by weight based on 100 parts by weight of the resin.

8. A charging device comprising the charging member according to claim 1.

9. A process cartridge detachable from an image forming apparatus, comprising:

an image holding member; and the charging device according to claim 8 that charges the image holding member.

10. An image forming apparatus comprising:

an image holding member;

a latent image forming device according to claim 8 that charges the image holding member;

a latent image forming device that forms a latent image on the surface of a charged image holding member;

a developing device that develops the latent image formed on the surface of the image holding member with a toner to form a toner image; and a transfer device that transfers the toner image formed on the surface of the image holding member to a recording medium.

11. A charging member comprising:

a conductive elastic layer; and a conductive surface layer that is disposed on the conductive elastic layer, is in contact with an image holding member, and contains a resin, porous resin particles, and silicone oil, wherein a content of the porous resin particles is from 3 parts by weight to 25 parts by weight based on 100 parts by weight of the resin, and a content of the silicone oil is from 0.1 part by weight to 10 parts by weight based on 100 parts by weight of the resin, and wherein the silicone oil is at least one kind selected from the group consisting of polyether-modified silicone oil and polyester-modified silicone oil.

* * * * *